US008814315B2

(12) United States Patent
Ueno et al.

(10) Patent No.: US 8,814,315 B2
(45) Date of Patent: Aug. 26, 2014

(54) RECORDING APPARATUS

(75) Inventors: Hiroyuki Ueno, Yamagata (JP); Yutaka Watanabe, Yamagata (JP)

(73) Assignee: Seiko Epson Corporation, Tokyo (JP)

( * ) Notice: Subject to any disclaimer, the term of this patent is extended or adjusted under 35 U.S.C. 154(b) by 136 days.

(21) Appl. No.: 13/408,004

(22) Filed: Feb. 29, 2012

(65) Prior Publication Data

US 2012/0236062 A1 Sep. 20, 2012

(30) Foreign Application Priority Data

Mar. 16, 2011 (JP) ..... 2011-057673

(51) Int. Cl.
*B41J 29/38* (2006.01)
*B41J 29/02* (2006.01)
*B41J 2/175* (2006.01)

(52) U.S. Cl.
CPC ..... *B41J 2/17593* (2013.01); *B41J 29/02* (2013.01)
USPC ..... 347/17

(58) Field of Classification Search
USPC ..... 347/17, 19
See application file for complete search history.

(56) References Cited

U.S. PATENT DOCUMENTS

2008/0174627 A1* 7/2008 Kamiyama ..... 347/17
2009/0267985 A1* 10/2009 Usui ..... 347/18

FOREIGN PATENT DOCUMENTS

JP 2004-299236 A 10/2004
JP 2005-007583 A 1/2005
JP 2005-138463 A 6/2005
JP 2006-175644 A 7/2006
JP 2006-175645 A 7/2006
JP 2010-280113 A 12/2010

OTHER PUBLICATIONS

Machine English Tranlation of JP 2010-280113.*

* cited by examiner

*Primary Examiner* — Stephen Meier
*Assistant Examiner* — Sharon A Polk
(74) *Attorney, Agent, or Firm* — Global IP Counselors, LLP

(57) ABSTRACT

A recording apparatus includes a carriage, a chamber room, a heating part and an agitating part. A recording head is mounted on the carriage. The chamber room covers the carriage while allowing a nozzle face of the recording head to be exposed. The heating part is configured and arranged to heat an atmosphere inside of the chamber room. The agitating part is configured and arranged to agitate the atmosphere heated by the heating part.

8 Claims, 11 Drawing Sheets

RECORDING APPARATUS

CROSS-REFERENCE TO RELATED APPLICATIONS

This application claims priority to Japanese Patent Application No. 2011-057673 filed on Mar. 16, 2011. The entire disclosure of Japanese Patent Application No. 2011-057673 is hereby incorporated herein by reference.

BACKGROUND

1. Technical Field

The present invention relates to a recording apparatus whereby a carriage on which recording heads are mounted is moved in relation to a recording medium to perform recording.

2. Related Art

There are conventionally known recording apparatuses comprising a heating part (ink heat application means) installed by being detachably wound around a nozzle face provided with the nozzles of a recording head (inkjet head) (refer to Japanese Laid-Open Patent Publication No. 2005-007583). This heating part is constructed of a U-shaped heat application frame that is made to adhere closely to, and is wound around, the lower part of the recording head, and a channel for circulating warm water driven by warm water circulation means, the channel being formed in the heat application frame.

In this heating part, heat is applied to (exchanged with) the ink passing through the recording head by the circulation of warm water in the channel, the viscosity of the ink is reduced, and the clogging of ink in the nozzle is prevented.

SUMMARY

However, the heating part provided in conventional recording apparatuses applies heat only near the nozzle face of the recording head. Accordingly, when recording is continuously performed and room-temperature ink is continuously supplied to the recording head through the channel from the ink supply source, the ink is not heated (heat is not applied) in time, and the ink is supplied to the nozzles before reaching the appropriate viscosity. A problem therefore arises in which the nozzles are clogged by ink whose temperature has not been raised and whose viscosity is still high.

In addition, in cases in which a plurality of recording heads is used, another problem arises in which heating part must be provided to all of the recording heads, resulting in a structurally complicated apparatus and an increase in cost.

An object of the present invention is to provide a recording apparatus in which ink or another functional fluid can be stably heated regardless of the supply rate.

A recording apparatus according to one aspect of the present invention includes a carriage, a chamber room, a heating part and an agitating part. A recording head is mounted on the carriage. The chamber room covers the carriage while allowing a nozzle face of the recording head to be exposed. The heating part is configured and arranged to heat an atmosphere inside of the chamber room. The agitating part is configured and arranged to agitate the atmosphere heated by the heating part.

According to this aspect, the atmosphere in the chamber room for covering the carriage is warmed, making it possible to warm the entire recording head mounted on the carriage. As a matter of course, the channel (tube) for supplying ink or another functional fluid is connected to the recording head, and this channel is also warmed at the same time. In addition, the space in the chamber room can be uniformly warmed by the agitating part all the way to the corners. Accordingly, functional fluid passing through the recording head and the channel connected to the recording head is securely heated before reaching the nozzle face of the recording head via the atmosphere in the chamber room. The functional fluid is thereby heated so as to have an appropriate viscosity and is supplied to the recording head even when continuously supplied from the supply source for continuous recording. Clogging of the nozzles on the recording head and insufficient discharge rates due to functional fluid having an inadequate viscosity can therefore be effectively prevented.

The chamber room is made to adhere closely to the carriage. The channel and cable connected to the recording head are extended to the outside through the chamber room, and the sections through which the channel and cable extend in this manner are sealed. Specifically, the chamber room is an enclosed space having substantially the same pressure as the outside pressure.

In this case, the recording apparatus preferably further a temperature detection part configured and arranged to detect a temperature of the atmosphere, and a control part configured to control the heating part based on detection results of the temperature detection part so that the atmosphere has a prescribed temperature.

According to this aspect, the temperature of the atmosphere in the chamber room can be maintained at a preset (prescribed) temperature. Functional fluid passing through the recording head and the channel connected to the recording head is thereby heated and maintained at a prescribed temperature (appropriate viscosity).

In this case, the agitating part preferably includes a ventilation fan configured and arranged to cause the atmosphere to flow, a manifold having a plurality of outlets connected to an air-supply port of the ventilation fan, and an intake chamber connected to an intake port of the ventilation fan.

According to this aspect, the atmosphere taken in by the intake port is supplied from a plurality of outlets on the manifold by the driving of the ventilation fan, whereby the atmosphere in the chamber room can be circulated. The entire space in the chamber room can be agitated because the atmosphere is supplied from a plurality of outlets. The atmosphere can thereby be maintained at a constant temperature without stagnating in the chamber room. Accordingly, functional fluid passing through the recording head and the channel connected to the recording head can be heated to a uniform temperature.

In this case, the intake chamber preferably includes an upper chamber disposed between an upper wall and a top wall of the chamber room, and a side chamber disposed between an exterior wall and an interior wall of the chamber room and provided in communication with the upper chamber, a plurality of inlets is preferably formed in the top wall, and a connection port connected to an intake port of the ventilation fan is preferably formed in the interior wall.

In addition, the intake chamber preferably includes an upper chamber disposed between an upper wall and a top wall of the chamber room, and a side chamber disposed between an exterior wall and an interior wall of the chamber room and provided in communication with the upper chamber and the manifold, and a connection port connected to an intake port of the ventilation fan is preferably formed in the top wall.

According to these aspects, the warmed atmosphere rises in the chamber room, and the atmosphere in the chamber room passes through the upper chamber and the side chamber and returns again to the chamber room. Therefore, the atmosphere can be efficiently taken in and uniformly circulated by providing a plurality of inlets or a ventilation fan.

In this case, the recording head is preferably mounted in a plural number in alignment on the carriage with spaces therebetween, and the outlets of the manifold are preferably disposed facing the spaces between the recording heads.

According to this aspect, the heated atmosphere is blown directly on each of the recording heads by the air supplied from the outlets. The recording heads are thereby selectively warmed, and the functional fluid passing through the recording heads is therefore efficiently heated.

In this case, the manifold is preferably disposed in a lower-end corner part of the chamber room.

According to this aspect, the warmed atmosphere rises in the chamber room, allowing the temperature difference between the upper part and the lower part in the chamber room to be reduced by positioning the manifold in the lower-end corner part of the chamber room. In addition, a rising airflow is formed in the chamber room, allowing the atmosphere in the chamber room to be efficiently circulated (agitated).

In this case, the recording apparatus preferably further includes a head drive part configured and arranged to apply, in order to heat the nozzle face of the recording head, an aperiodic waveform to the recording head to the extent that droplets are not discharged from nozzles formed in the nozzle face, a head temperature detection part configured and arranged to detect a temperature of the recording head, and a head control part configured to control the head drive part based on detection results of the head temperature detection part so that the recording head has a prescribed temperature.

According to this aspect, the functional fluid facing the nozzle section can be warmed by applying an aperiodic waveform to the recording head. In addition, the temperature of the functional fluid in the nozzles can be finely adjusted by detecting and controlling the temperature of the recording head. Clogging of the nozzles can thereby be effectively prevented.

BRIEF DESCRIPTION OF THE DRAWINGS

Referring now to the attached drawings which form a part of this original disclosure.

DETAILED DESCRIPTION OF EXEMPLARY EMBODIMENTS

Figure 1:
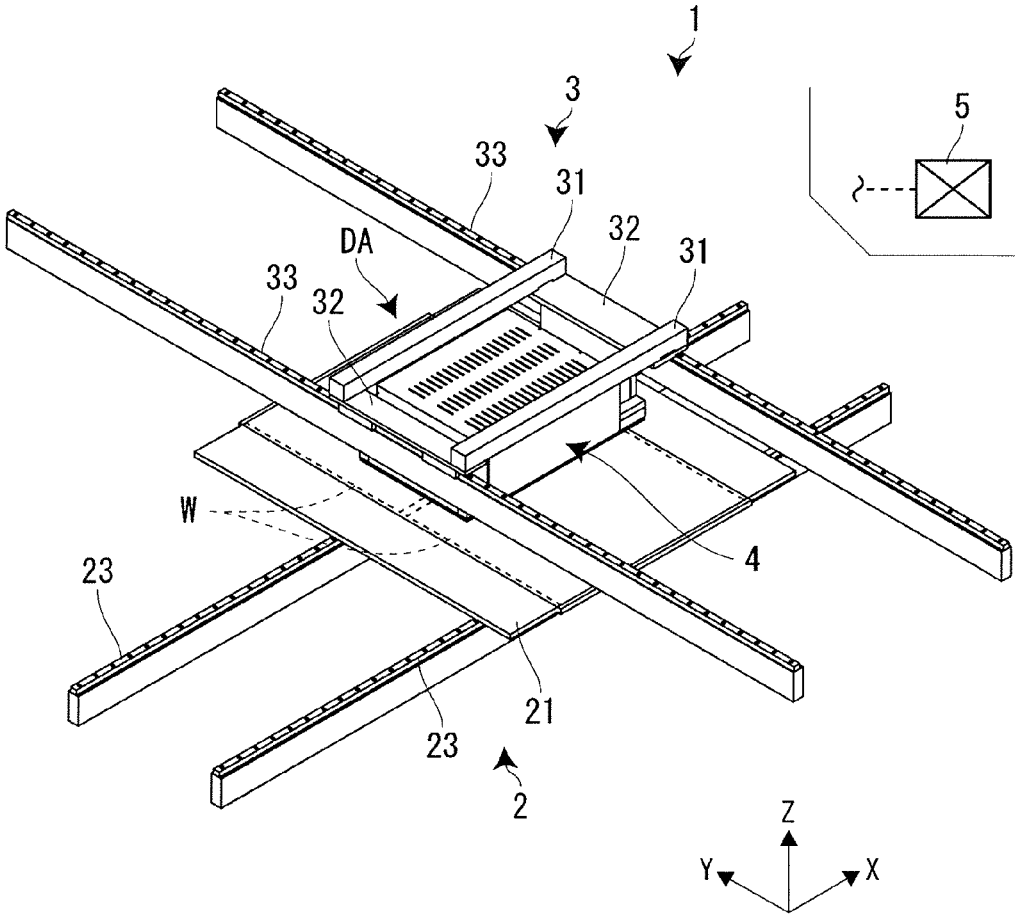
FIG. 1 is a perspective view schematically showing a recording apparatus.

A recording apparatus according to a first embodiment of the present invention will be described below with reference to the attached drawings. In the recording apparatus, ultraviolet-curable ink (UV ink), for example, is discharged on a work (recording medium) by a recording head to draw (print) a desired image or the like. In the following description, the directions of the x-axis, y-axis, and z-axis are defined as shown in the drawings.

Figure 2:
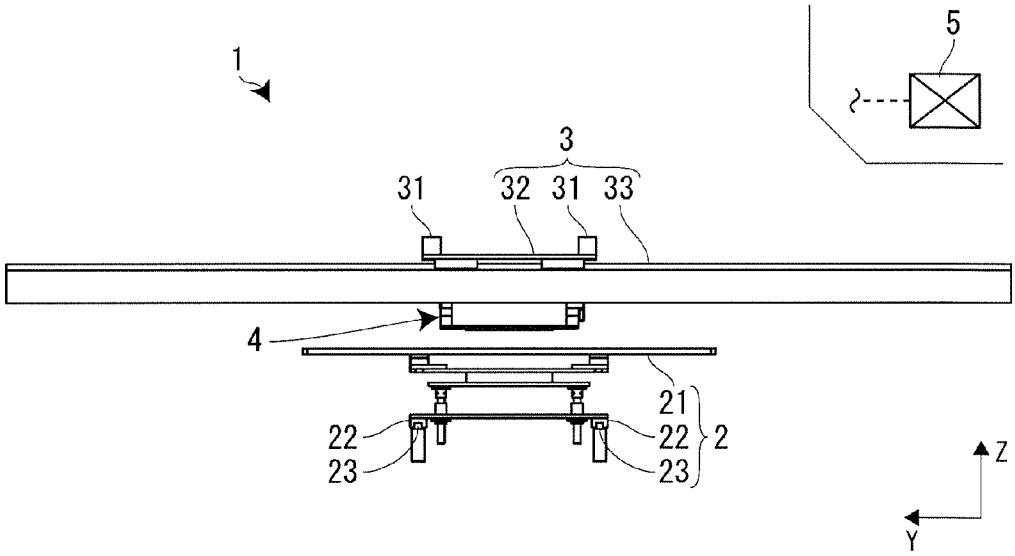
FIG. 2 is a front view schematically showing a recording apparatus.

A recording apparatus 1 is provided with an x-axis table 2 extending in the direction of the x-axis and causing a work W to move in the direction of the x-axis, a y-axis table 3 spanning across the x-axis table 2 so as to straddle the x-axis table 2 and extending in the direction of the y-axis, a recording unit 4 on which a plurality of recording heads 45 is mounted, and a control device 5 for performing overall control of the entire apparatus, as shown in FIGS. 1 and 2. Although this is omitted from the drawings, the recording apparatus 1 is also provided with a functional fluid supply unit for supplying functional fluid to the recording heads 45, and a maintenance device for maintaining and recovering the functions of the recording heads 45.

The section in the recording apparatus 1 where the x-axis table 2 and the y-axis table 3 intersect each other is the drawing area DA in which information is drawn (printed) by the recording heads 45.

The control apparatus 5 drives the x-axis table 2 and the y-axis table 3 in synchrony with each other, and causes a multicolored functional fluid to be discharged from the recording heads 45 in the drawing area DA. A prescribed drawing is thereby performed on the work W. The control device 5 drives the y-axis table 3 and causes the recording unit 4 to be disposed facing the maintenance device to maintain and recover the functions of the recording heads 45.

The x-axis table 2 has a work stage 21 provided with a mechanism correctable in the direction of the θ-axis and used for setting the work W by suction, a pair of x-axis sliders 22 assembled with linear motors and used for supporting the work stage 21, and a pair of x-axis guide rails 23 extending in the direction of the x-axis and guiding the movement of the x-axis sliders 22 in the direction of the x-axis.

The y-axis table 3 has a pair of bridge members 31 by which the recording unit 4 are suspended, a pair of y-axis sliders 32 assembled with linear motors and used for supporting each of the bridge members 31 on both sides, and a pair of y-axis guide rails 33 extending in the direction of the y-axis and guiding the movement of the y-axis sliders 32 in the direction of the y-axis.

Figure 3A:
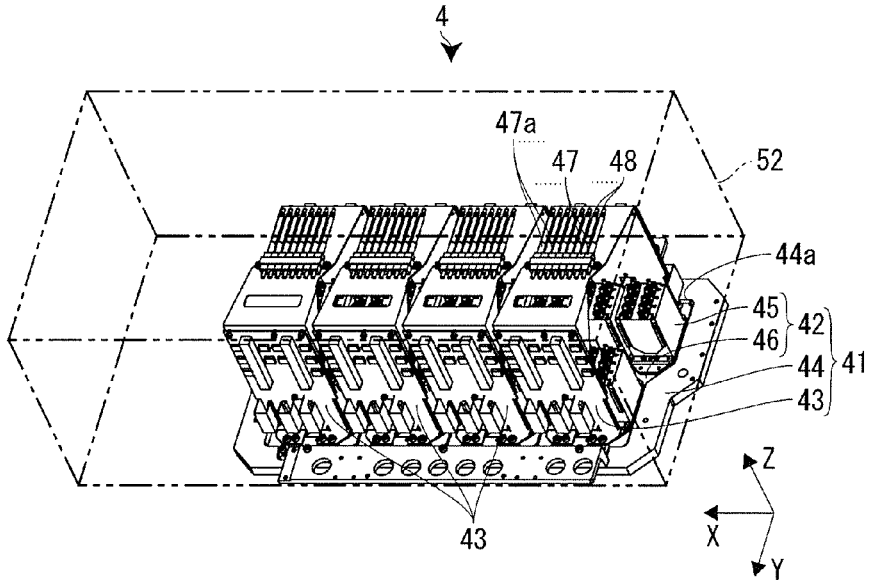
FIG. 3 is a front and rear perspective view of a recording unit (carriage)
Figure 3B:
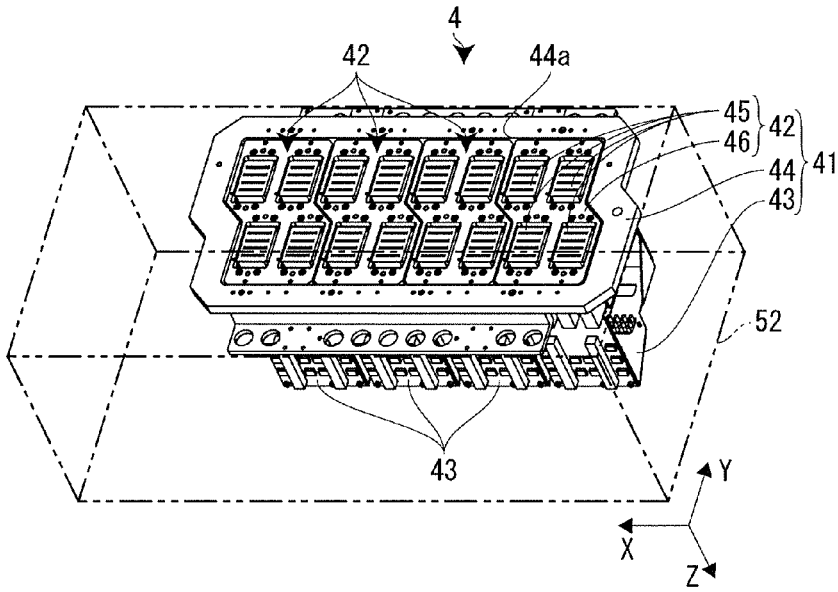

The recording unit 4 is provided with a carriage 41 having head units 42 on which the plurality of recording heads 45 is mounted, and a chamber unit 51 (refer to FIG. 6) provided so as to cover the carriage 41, as shown in FIG. 3. The recording unit 4 is supported on the y-axis table 3 by a suspension member (not shown) with a lift mechanism.

The carriage 41 has four head units 42 on which the plurality of recording heads 45 is mounted, four tube-holding members 43 for holding a plurality of upstream tubes 48 as channels for functional fluid on the head units 42, and a main head plate 44 on which the four head units 42 are installed in alignment.

Each of the head units 42 has four recording heads 45 for discharging functional fluid by ink jetting, and a subhead plate 46 on which the recording heads 45 are installed.

Figure 4:
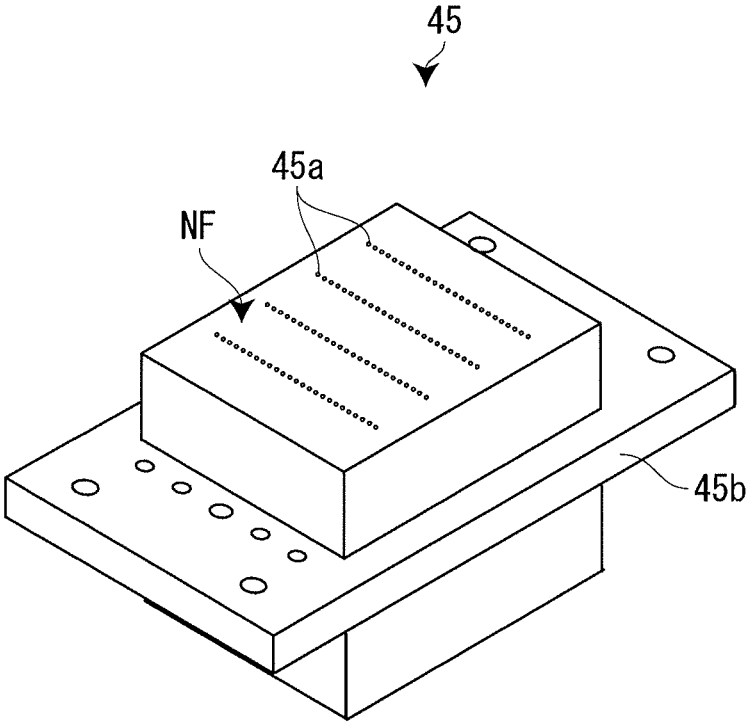
FIG. 4 is a perspective view of a recording head.

Each of the recording heads 45 has a plurality (four) of nozzle rows formed of a plurality of discharge nozzles 45*a* disposed parallel to a nozzle face NF, as shown in FIG. 4. Each of the recording heads 45 is also provided with a flange part 45*b* on the nozzle face NF as a site for fixing the recording heads to the subhead plate 46. The number of discharge nozzles 45*a* and nozzle rows on a single recording head 45 is arbitrary.

Figure 5:
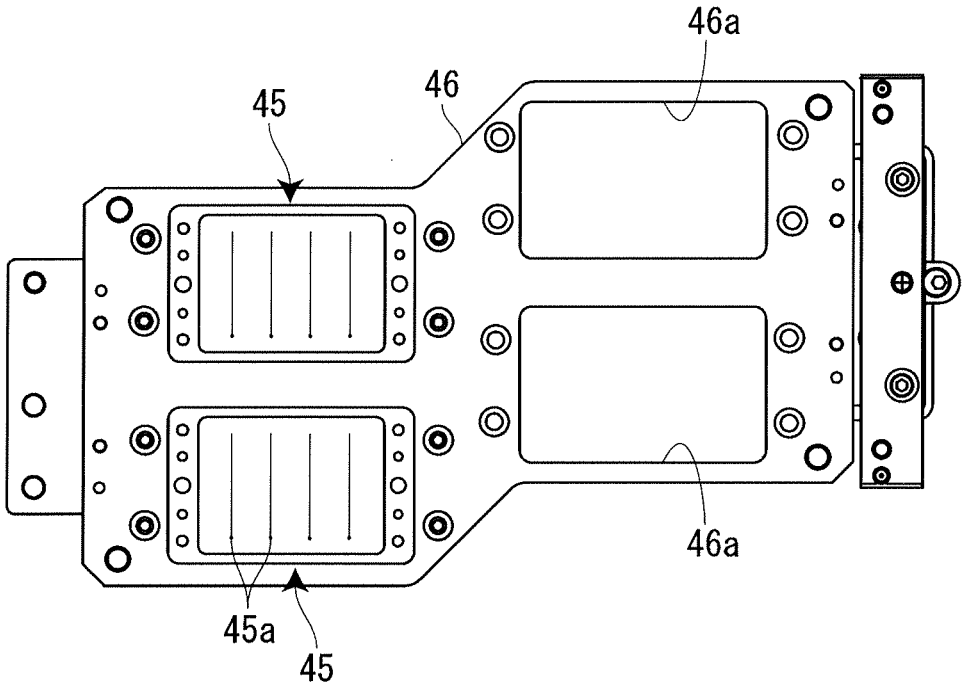
FIG. 5 is a bottom view of a subhead plate and a recording head.

The subhead plates 46 are stainless steel plates or other thick plates formed into a substantially crank shape, as shown in FIG. 5. Four head-installation openings 46*a* formed all the way through the plates in the plate thickness direction are provided in a staggered manner to each of the subhead plates 46. The recording heads 45 are attached to the head-installation openings 46*a* so that the nozzle faces NF are exposed downward. Although this is omitted from the drawings, the gap between each of the recording heads 45 and head-installation openings 46*a* is blocked by a sealing element (airtight element). The number of recording heads 45 installed on a single subhead plate 46 and the arrangement pattern thereof are arbitrary.

The tube-holding members 43 are formed in a reverse U-shape and are positioned so as to straddle the recording heads 45 mounted on the subhead plates 46, as shown in FIG. 3. The tube-holding members 43 are fixed to the subhead plates 46 by a pair of leg sections.

A plurality (eight in the present embodiment) of joint members 47 for feeding functional fluid supplied from the functional fluid supply unit to the recording heads 45 is fixed to the upper surface of each of the tube-holding members 43. Each of the joint members 47 has an incoming connection port 47*a* protruding in the direction of the x-axis and two outgoing connection ports 47*b* passing through from the upper surface of the tube-holding member 43 and protruding downward. The upstream tubes 48 provided in communication with the functional fluid supply unit are connected to the incoming connection ports 47*a*. Downstream tubes 49 provided in communication with the recording heads 45 are connected to the outgoing connection ports 47*b* (refer to FIG. 8). The downstream tubes 49 diverge into two parts downstream, and eight downstream tubes 49 (enough for two upstream tubes 48) are connected to a single recording head 45.

The main head plate 44 is a stainless steel plate or other thick plate formed into a substantially crank shape, as shown in FIG. 3. A plate-installation opening 44*a* having a substantially crank shape is formed in the main head plate 44 all the way through the plate in the plate thickness direction. Four head units 42 (subhead plates 46) are aligned in the lengthwise direction (x-axis) and attached to the plate-installation openings 44*a*. Although this is omitted from the drawings, the gap between each of the subhead plates 46 and the main head plate 44 is blocked by a sealing element (airtight element). The number of subhead plates 46 installed on the main head plate 44 and the arrangement pattern thereof are arbitrary.

When the functional fluid used herein has a high viscosity, problems arise in that the discharge nozzles 45*a* become clogged, the discharge rate decreases, or the like. The viscosity must therefore be reduced by warming the functional fluid.

In view of this, the entire carriage 41 in the recording apparatus 1 according to the present embodiment is covered by the chamber unit 51 and warmed, whereby heat is applied to the functional fluid passing through the recording heads 45, and the viscosity is managed so as to be at an appropriate level.

Figure 6:
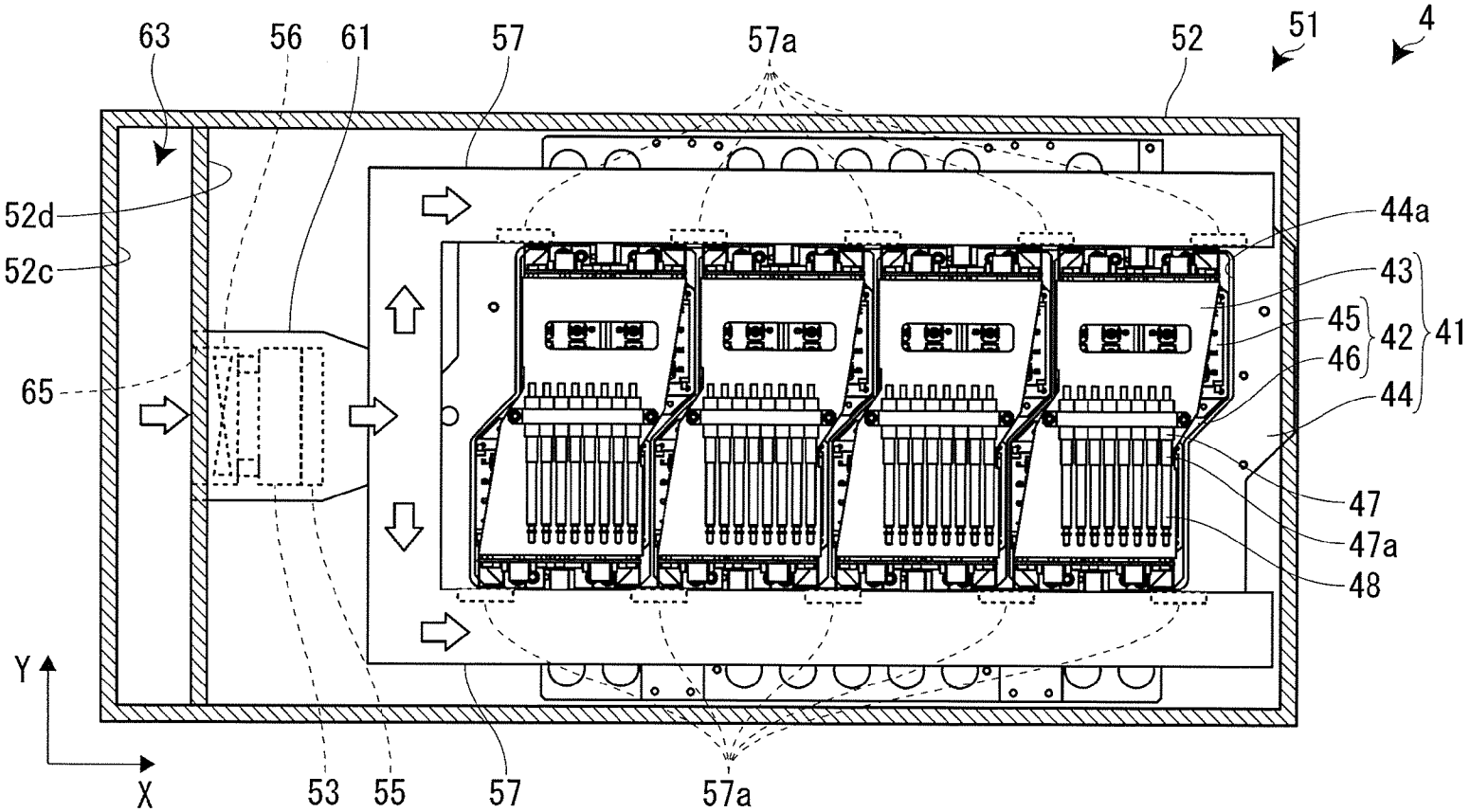
FIG. 6 is a cross-sectional plan view of a carriage and a chamber unit according to the first embodiment.
Figure 7:
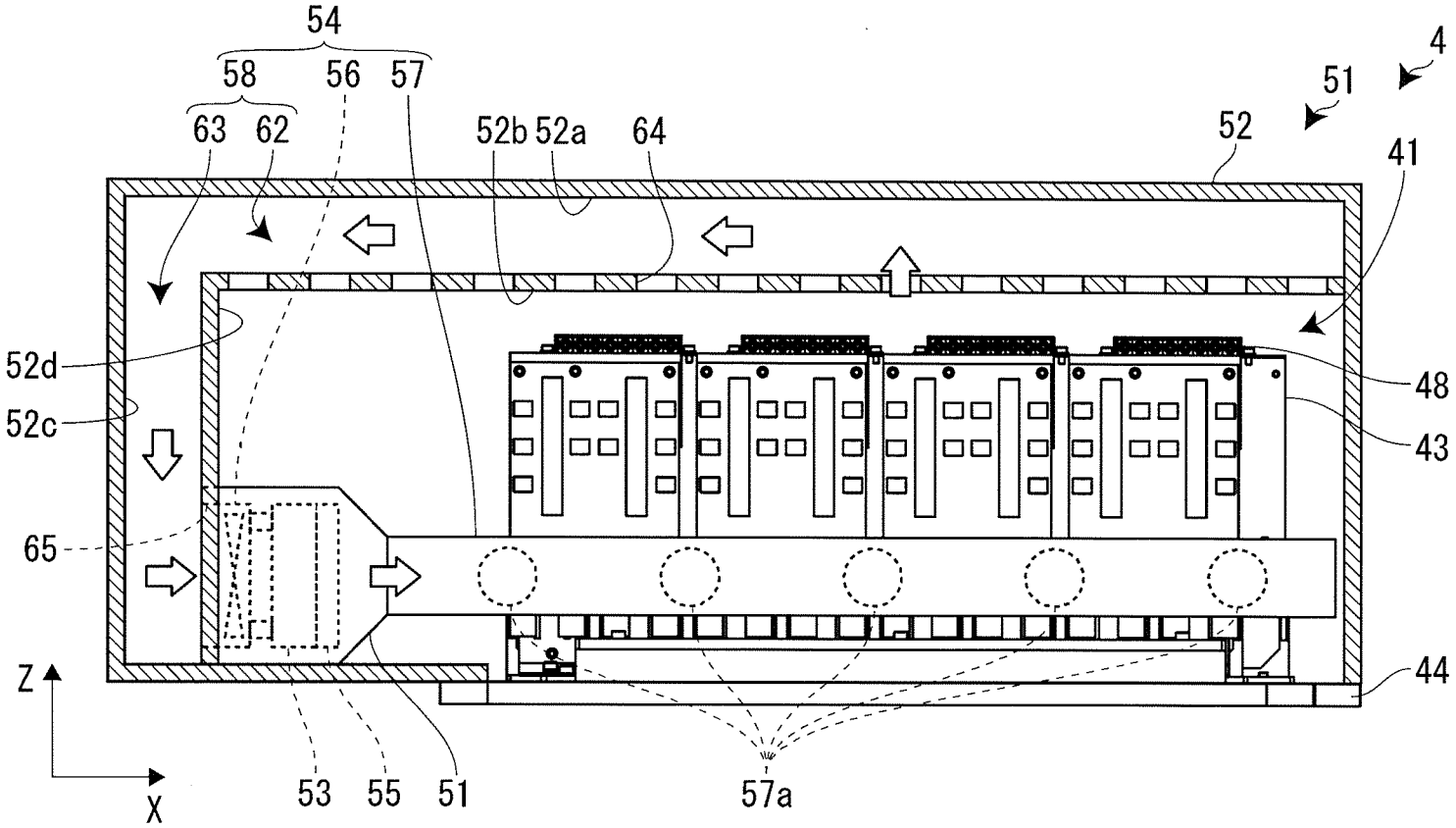
FIG. 7 is a cross-sectional front view of a carriage and a chamber unit according to the first embodiment.
Figure 8:
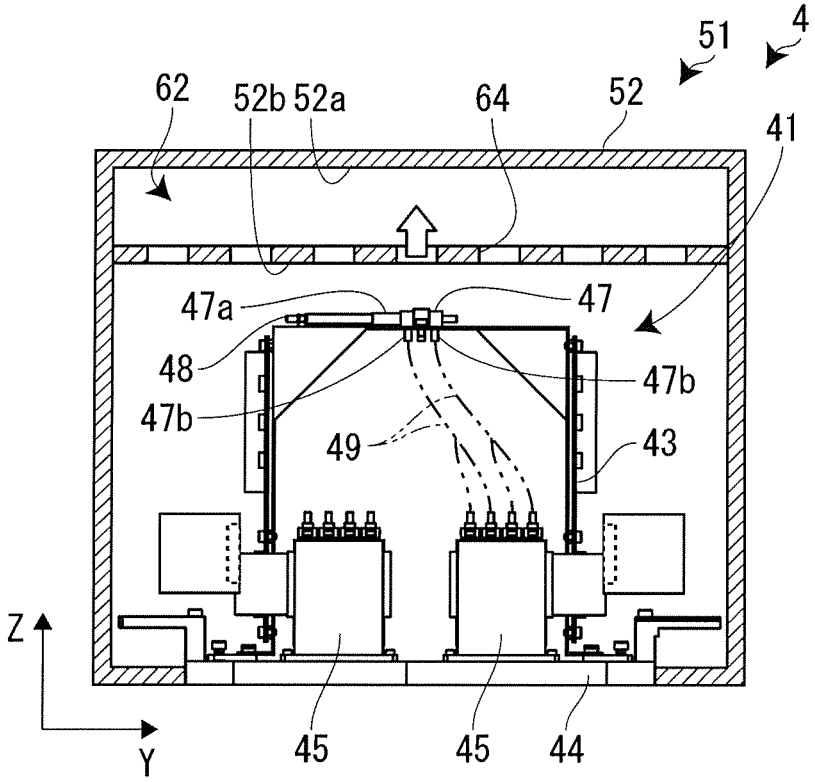
FIG. 8 is a cross-sectional side view of a carriage and a chamber unit according to the first embodiment.

The chamber unit 51 includes a chamber room 52 provided so as to cover the carriage 41 while allowing the nozzle faces NF of the recording heads 45 to be exposed, a heating part 53 for heating the atmosphere inside of the chamber room 52, an agitating part 54 that agitates the atmosphere heated by the heating part 53, and a temperature detection part 55 for detecting the temperature of the atmosphere inside of the chamber room 52, as shown in FIGS. 6 to 8. The "control part" described corresponds to the control device 5 in this embodiment. The arrows in the drawings show the flow of the air (atmosphere).

The chamber room 52 is formed in the shape of a box without a bottom. The chamber room 52 covers the carriage 41 from above, and is fixed in close adherence to the main head plate 44. The exterior of the chamber room 52 is formed by an adiabatic resin. Although this is omitted from the drawings, the gap between the chamber room 52 and the main head plate 44 is blocked by a sealing element (airtight element). The upstream tubes 48 for supplying functional fluid to the recording heads 45, and a cable for sending control signals are extended to the outside through the chamber room 52, and the sections through which the tubes and the cable are extended are also blocked by a sealing element. Specifically, the chamber room 52 is an enclosed space having substantially the same pressure as the outside pressure.

The heating part 53 is an electric heater positioned at an air-supply port (downstream) of a ventilation fan 56 described below, and fixed inside of a communication chamber 61 described below.

The agitating part 54 has a ventilation fan 56 for causing the atmosphere inside of the chamber room 52 to flow, a pair of manifolds 57 provided with a plurality of outlets 57*a* connected to the air-supply port of the ventilation fan 56, and an intake chamber 58 connected to an intake port of the ventilation fan 56.

The ventilation fan 56 is disposed inside of the chamber room 52 at substantially the center in the direction of the y-axis. The ventilation fan 56 is fixed inside of the communication chamber 61 for providing communication between the manifolds 57 and the intake chamber 58. The ventilation fan 56 is disposed so as to be able to supply air from the intake chamber 58 toward the manifolds 57 in the communication chamber 61. The communication chamber 61 diverges into two parts downstream in the direction of the y-axis. The bifurcated sections of the communication chamber 61 are provided in communication with each of the manifolds 57. The driving of the ventilation fan 56 causes the atmosphere taken in via the intake chamber 58 to be sent out from the plurality of outlets 57*a* in the manifolds 57. The atmosphere in the chamber room 52 can thereby be circulated.

The pair of manifolds 57 extends in the direction of the x-axis in the lower-end corner part of the chamber room 52. The air (atmosphere) sent downstream from the ventilation fan 56 is warmed by the heating part 53 and released at the same flow rate from the plurality (five in the present embodiment) of outlets 57*a* in each of the manifolds 57. The warmed atmosphere rises in the chamber room 52, allowing the temperature difference between the upper part and the lower part in the chamber room 52 to be reduced by positioning the pair of manifolds 57 in the lower-end corner part. That is, the temperature of the atmosphere in the chamber room 52 can be made uniform.

Each of the outlets 57*a* of the manifolds 57 is disposed facing the gap between the two end sections in the direction of the x-axis and the adjacent subhead plates 46. Accordingly, the outlets of the pair of manifolds 57 are disposed facing inward opposite each other. The heated air (atmosphere) released from the outlets 57*a* is blown directly on the recording heads 45. The recording heads 45 are thereby selectively warmed, and the functional fluid passing through the recording heads 45 is therefore efficiently heated.

The intake chamber 58 has an upper chamber 62 disposed between an upper wall 52*a* and a top wall 52*b* of the chamber room 52, and a side chamber 63 disposed between an exterior wall 52*c* and an interior wall 52*d* of the chamber room 52 and provided in communication with the upper chamber 62.

The upper chamber 62 is the space provided over the entire surface of the upper part in the chamber room 52. A plurality of inlets 64 provided in communication with the upper chamber 62 is formed in a staggered manner in the top wall 52*b*. The atmosphere in the chamber room 52 is warmed and caused to rise. The atmosphere in the chamber room 52 is circulated by driving the ventilation fan 56, and is therefore taken into the upper chamber 62 through the plurality of inlets 64. Therefore, the atmosphere can be efficiently taken in and uniformly circulated by providing the plurality of inlets 64 to the top wall 52*b*. The formation pattern of the plurality of inlets 64 is not limited to a staggered pattern, but may also be a matrix shape, for example.

The side chamber 63 is the space provided over the entire surface of one side in the chamber room 52 in the direction of the x-axis, in communication with the upper chamber 62 in the upper part. Specifically, the intake chamber 58 constitutes an L-shaped space integrally formed by the upper chamber 62 and the side chamber 63. A connection port 65 to which the intake port of the ventilation fan 56 is connected is formed in substantially the center of the lower part of the interior wall 52*d* in the direction of the y-axis. The side chamber 63 and the communication chamber 61 are provided in communication with each other via the connection port 65.

Accordingly, the air sent out by the ventilation fan 56 is heated by the heating part 53 and released from the plurality of outlets 57*a* through the communication chamber 61 and the manifolds 57. The heated and released air is used to heat and agitate the atmosphere in the chamber room 52. The heated atmosphere is caused to rise and is then taken into the upper chamber 62 through the plurality of inlets 64 formed in the top wall 52*b*. The taken-in atmosphere is caused to flow from the upper chamber 62 to the side chamber 63 by the intake operation of the ventilation fan 56, and is sent out again toward the chamber room 52 by the ventilation fan 56. A rising airflow is thereby formed in the chamber room 52, and the atmosphere is efficiently circulated (agitated). Stagnation of atmosphere in the chamber room 52 can thereby be prevented, and the atmosphere can be maintained at a constant temperature.

The temperature detection part 55 is constructed of a thermocouple attached to the downstream side of the heating part 53. The control device 5 provides feedback control to the heating part 53 based on the detection results of the temperature detection part 55 so that the atmosphere in the chamber room 52 has a preset temperature (about 45° C. in the present embodiment). The functional fluid passing through the upstream tubes 48 and the downstream tubes 49 in the recording heads 45 in the chamber room 52 is thereby heated and maintained at a set temperature (appropriate viscosity). The control device 5 may also provide feedback control for the ventilation rate (revolution speed) of the ventilation fan 56 in addition to the heating part 53 based on the detection results of the temperature detection part 55.

Although this is omitted from the drawings, the attachment position of the temperature detection part 55 may, as a modification, be in the chamber room 52 instead of on the downstream side of the heating part 53. The temperature detection part 55 can be attached in an arbitrary position in the chamber room 52, but is preferably attached to one of the two centrally located tube-holding members 43 aligned in the direction of the x-axis. The temperature near the center of the chamber room 52 can thereby be detected. A plurality of temperature detection part 55 may be provided so as to be able to detect the temperature at a plurality of positions in the chamber room 52. In addition, the temperature detection part 55 may be disposed both on the downstream side of the heating part 53 and inside of the chamber room 52.

The recording heads 45, the tubes 48, 49, and all of the other elements mounted on the carriage 41 can be uniformly warmed by using the aforedescribed chamber unit 51. However, the nozzle faces NF of the recording heads 45 are exposed downward (to the outside of the chamber room 52), causing the temperature of the functional fluid in the discharge nozzles 45*a* to decrease slightly and the viscosity to increase.

In view of this, in the recording apparatus 1 according to the present embodiment, the control device 5 applies an aperiodic waveform to the recording heads 45 to the extent that functional fluid (droplets) is not discharged from the discharge nozzles 45*a*. In this case, a head temperature detection part (thermocouple (not shown)) for detecting the temperature of the nozzle faces NF is preferably provided to the recording heads 45, and the control device 5 preferably applies an aperiodic waveform based on the detection results of the head temperature detection part so as to have a set temperature. The temperature of the functional fluid in the discharge nozzles 45*a* can thus be finely adjusted by detecting and controlling the temperature of the recording heads 45 (nozzle faces NF). Nozzle clogging can thereby be effectively prevented. The "head drive part" and the "head control part" correspond to the functions performed by the control device 5 in this embodiment.

According to the aforedescribed aspect, the atmosphere in the chamber room 52 for covering the carriage 41 can be warmed, allowing the recording heads 45, the upstream tubes 48, and the downstream tubes 49 mounted on the carriage 41 to be warmed at the same time. In addition, the space in the chamber room 52 can be uniformly warmed by the agitating part 54 all the way to the corners. Accordingly, the functional fluid can be securely heated before reaching the nozzle faces NF of the recording heads 45. The functional fluid is thereby heated so as to have an appropriate viscosity and is supplied to the recording heads 45 even when continuously discharged and continuously supplied from the functional fluid supply unit. Nozzle clogging and insufficient discharge rates due to functional fluid having an inadequate viscosity can therefore be effectively prevented.

Second Embodiment

Figure 9:
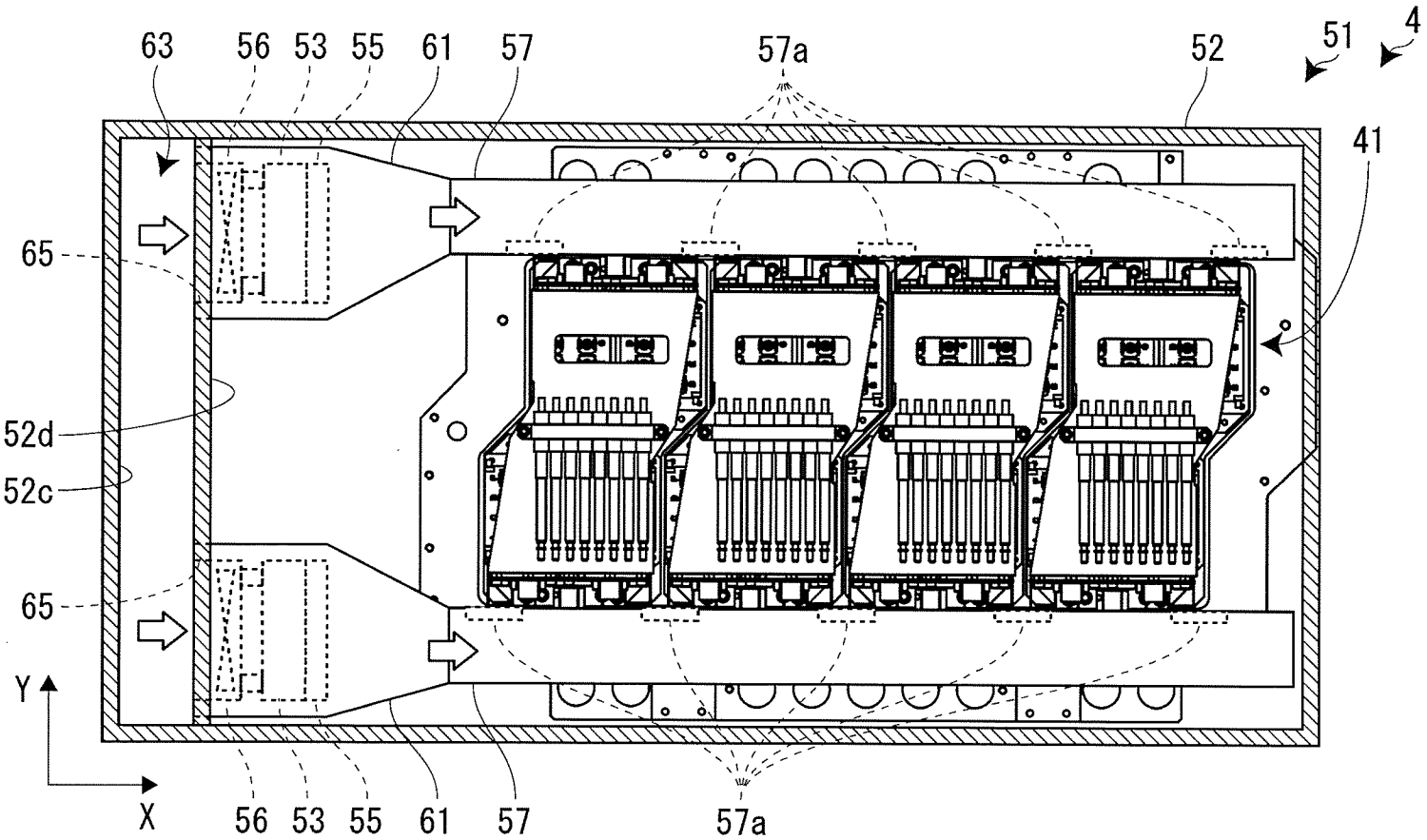
FIG. 9 is a cross-sectional plan view of a carriage and a chamber unit according to the second embodiment.

The recording apparatus 1 according to a second embodiment of the present invention will be described with reference to FIG. 9. Descriptions that are the same as those for the recording apparatus 1 according to the first embodiment will be omitted.

The agitating part 54 of the recording apparatus 1 according to the second embodiment is provided with two heating part 53 and two ventilation fans 56. In addition, a temperature detection part 55 is attached to the downstream side of each of the heating part 53. Connection ports 65 are formed in both end sections of the interior wall 52*d* in the direction of the y-axis. An intake port of the ventilation fan 56 is connected to each of the connection ports 65. The ventilation fans 56 are fixed inside of the communication chambers 61 for providing communication with the manifolds 57. The control device 5 provides feedback control to each of the heating part 53 based on the detection results of each of the temperature detection part 55.

According to this aspect, the atmosphere in the chamber room 52 can be rapidly heated to the set temperature because two agitating part 54 are provided. The functional fluid is thereby heated so as to have the appropriate viscosity, and inadequate discharge of the functional fluid and insufficient discharge rates can be effectively prevented.

Third Embodiment

Figure 10:
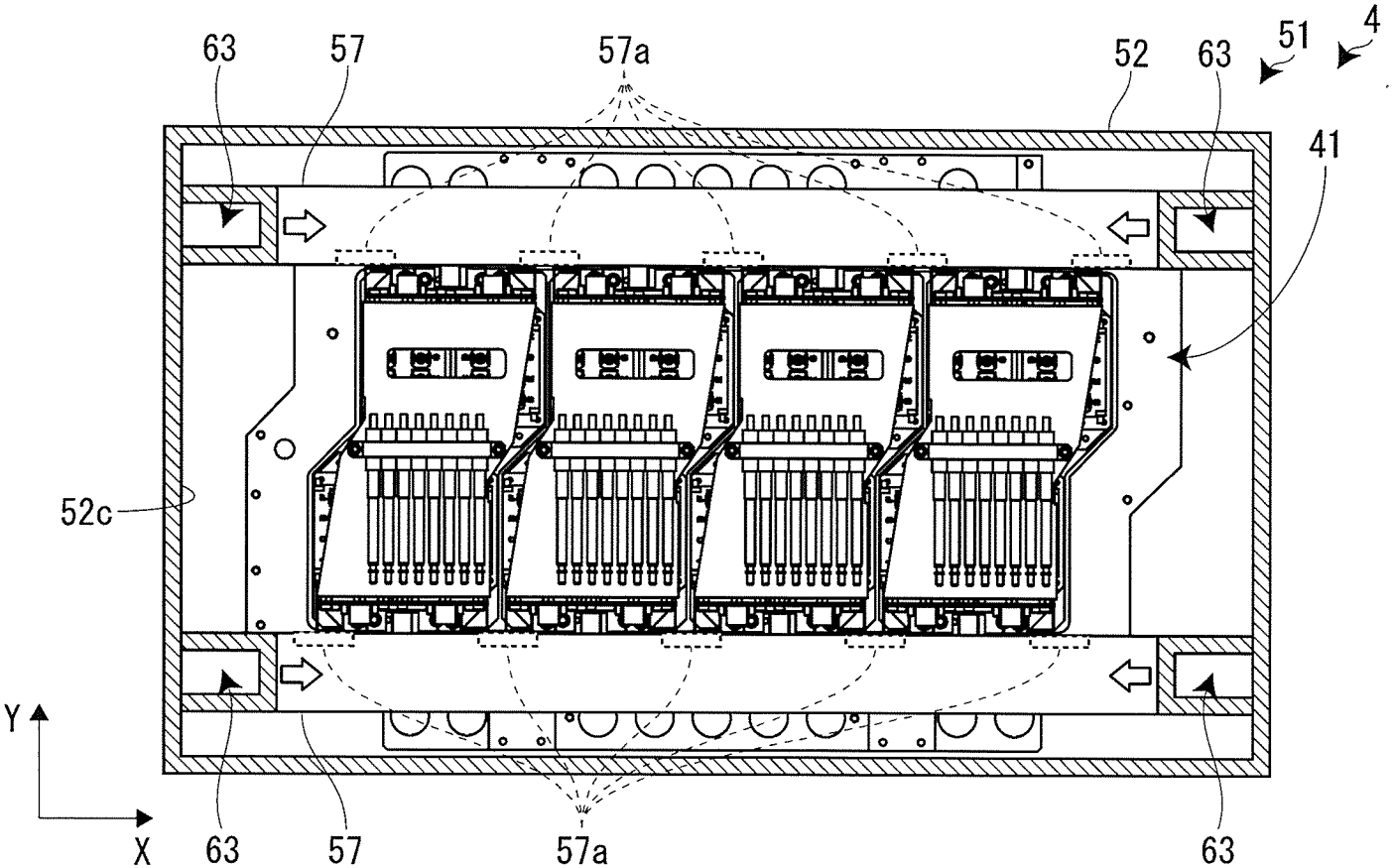
FIG. 10 is a cross-sectional plan view of a carriage and a chamber unit according to the third embodiment.
Figure 11:
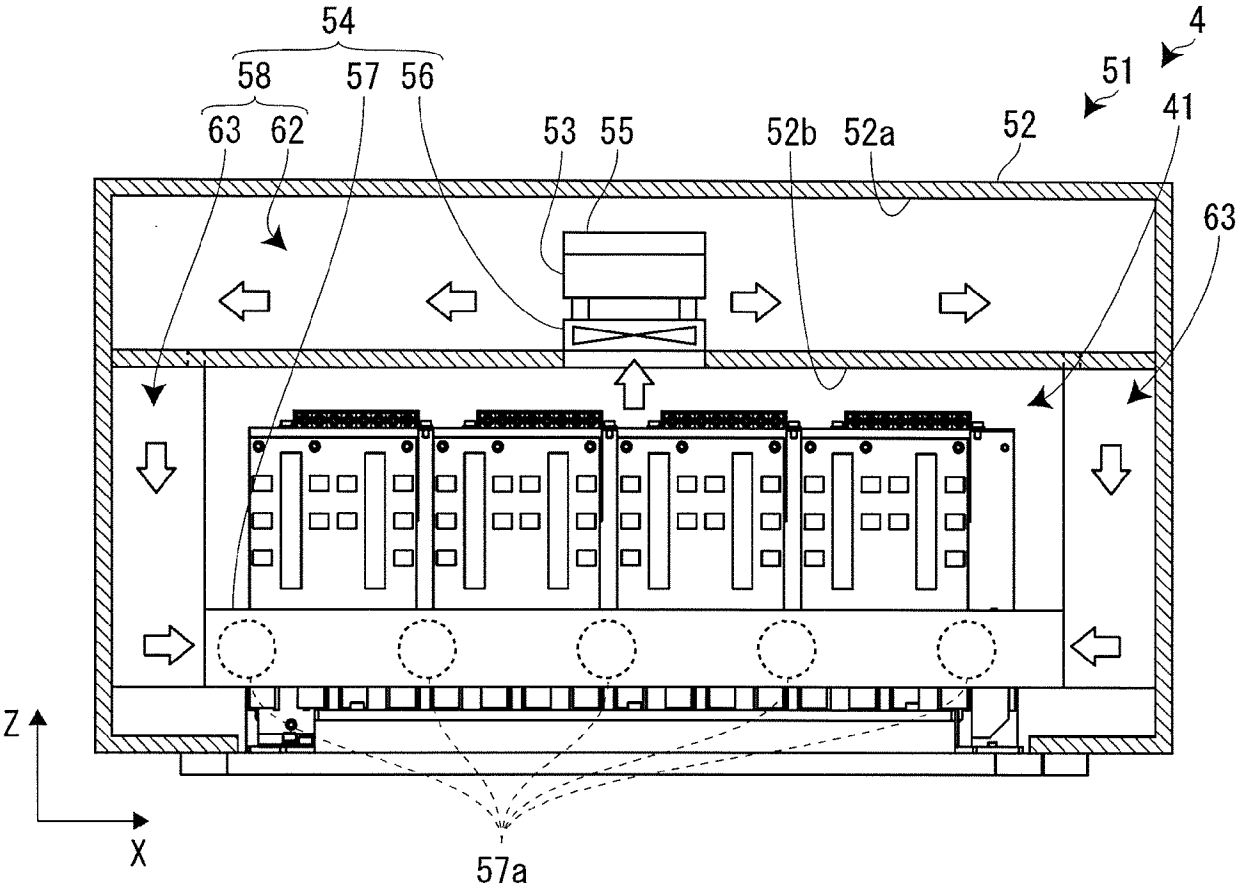
FIG. 11 is a cross-sectional front view of a carriage and a chamber unit according to the third embodiment.

The recording apparatus 1 according to a third embodiment of the present invention will be described with reference to FIGS. 10 and 11. Descriptions that are the same as those for the recording apparatus 1 according to the first embodiment will be omitted.

In the agitating part 54 of the recording apparatus 1 according to the third embodiment, the ventilation fan 56 is disposed in the upper chamber 62. Side chambers 63 are formed by a total of four ducts provided two each to the end parts in the direction of the x-axis. The two sets of pairs of the side chambers 63 aligned in the direction of the x-axis are provided in communication with the two end parts of the upper chamber 62 and the two end parts of the manifolds 57. Accordingly, the communication chamber 61 for providing communication between the manifolds 57 and the intake chamber 58 is omitted.

According to this aspect, the warmed atmosphere rises in the chamber room 52, and can therefore be efficiently taken in and uniformly circulated by providing the ventilation fan 56 in the upper chamber 62.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A recording apparatus comprising:

a carriage on which a recording head is mounted, the carriage being movably arranged in the recording apparatus;

a chamber room covering the carriage, a nozzle face of the recording head being exposed from a bottom portion of the chamber room to an outer space of the chamber room;

a heating part configured and arranged to heat an atmosphere inside of the chamber room; and an agitating part configured and arranged to agitate the atmosphere heated by the heating part, the heating part and the agitating part being disposed inside of the chamber room such that the heating part and the agitating part integrally move with the head in the recording apparatus.

2. A recording apparatus comprising a carriage on which a recording head is mounted;

a chamber room covering the carriage, a nozzle face of the recording head being exposed from a bottom portion of the chamber room to an outer space of the chamber room;

a heating part configured and arranged to heat an atmosphere inside of the chamber room;

an agitating part configured and arranged to agitate the atmosphere heated by the heating part, the agitating part being disposed inside of the chamber room, a temperature detection part configured and arranged to detect a temperature of the atmosphere, and a control part configured to control the heating part based on detection results of the temperature detection part so that the atmosphere has a prescribed temperature.

3. A recording apparatus comprising:

a carriage on which a recording head is mounted;

a chamber room covering the carriage while allowing a nozzle face of the recording head to be exposed;

a heating part configured and arranged to heat an atmosphere inside of the chamber room; and an agitating part configured and arranged to agitate the atmosphere heated by the heating part, the agitating part including a ventilation fan configured and arranged to cause the atmosphere to flow, a manifold having a plurality of outlets connected to an air-supply port of the ventilation fan, and an intake chamber connected to an intake port of the ventilation fan.

4. The recording apparatus according to claim 3, wherein the intake chamber includes an upper chamber disposed between an upper wall and a top wall of the chamber room, and a side chamber disposed between an exterior wall and an interior wall of the chamber room and provided in communication with the upper chamber, a plurality of inlets is formed in the top wall, and a connection port connected to an intake port of the ventilation fan is formed in the interior wall.

5. The recording apparatus according to claim 3, wherein the intake chamber includes an upper chamber disposed between an upper wall and a top wall of the chamber room, and a side chamber disposed between an exterior wall and an interior wall of the chamber room and provided in communication with the upper chamber and the manifold, and a connection port connected to an intake port of the ventilation fan is formed in the top wall.

6. The recording apparatus according to claim 3, wherein the recording head is mounted in a plural number in alignment on the carriage with spaces therebetween, and the outlets of the manifold are disposed facing the spaces between the recording heads.

7. The recording apparatus according to claim 3, wherein the manifold is disposed in a lower-end corner part of the chamber room.

8. A recording apparatus comprising:

a carriage on which a recording head is mounted;

a chamber room covering the carriage while allowing a nozzle face of the recording head to be exposed;

a heating part configured and arranged to heat an atmosphere inside of the chamber room;

an agitating part configured and arranged to agitate the atmosphere heated by the heating part;

a head drive part configured and arranged to apply, in order to heat the nozzle face of the recording head, an aperiodic waveform to the recording head to the extent that droplets are not discharged from nozzles formed in the nozzle face, a head temperature detection part configured and arranged to detect a temperature of the recording head, and a head control part configured to control the head drive part based on detection results of the head temperature detection part so that the recording head has a prescribed temperature.

* * * * *